US006283771B1

(12) United States Patent
Mitchell et al.

(10) Patent No.: US 6,283,771 B1
(45) **Date of Patent: *Sep. 4, 2001**

(54) GROUNDING TECHNIQUES TO IMPROVE THE PERFORMANCE OF RF COAXIAL LIGHTNING PROTECTOR

(75) Inventors: Ray Mitchell, Lake Hiawatha; Dheenadayalan Moongilan, Marlboro; Kevin Reid, Budd Lake; Anatoly Zaytsev, Rockaway, all of NJ (US)

(73) Assignee: Lucent Technologies, Inc., NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/059,507

(22) Filed: Apr. 13, 1998

(51) Int. Cl.[7] ..... H01R 4/66
(52) U.S. Cl. ..... 439/95; 439/97
(58) Field of Search ..... 439/95, 98, 101, 439/939, 915, 573, 544, 96, 97, 92; 361/120, 117, 118, 119

(56) References Cited

U.S. PATENT DOCUMENTS

| | | | | |
|---|---|---|---|---|
| 3,887,258 | * | 6/1975 | Cunningham et al. | 439/671 |
| 4,199,736 | * | 4/1980 | McTaggart et al. | 333/17 L |
| 4,236,188 | * | 11/1980 | Prochazka | 361/111 |
| 4,878,146 | * | 10/1989 | Kaczmarek | 361/119 |
| 5,491,776 | * | 2/1996 | Huynh et al. | 385/100 |
| 5,557,065 | * | 9/1996 | Brower et al. | 174/52.3 |
| 5,581,428 | * | 12/1996 | Smith | 361/119 |

* cited by examiner

*Primary Examiner*—Gary Paumen
*Assistant Examiner*—Ross Gushi

(57) ABSTRACT

A grounding system for improving the performance of an RF coaxial lightning protector having a housing for containing an RF coaxial lightning protector. The housing has a jack at one end and a plug at the other end. The system also includes a grounding device fabricated from a conductive material, which is connected to the housing and, in turn, connected to a grounding surface. The connections are such that a signal current can pass from the housing to the grounding surface through the grounding device.

8 Claims, 2 Drawing Sheets

GROUNDING TECHNIQUES TO IMPROVE THE PERFORMANCE OF RF COAXIAL LIGHTNING PROTECTOR

FIELD OF THE INVENTION

This invention relates to coaxial lightning protectors, and more particularly, to a grounding system for improving the performance of radio frequency (RF) coaxial lightning protectors employed in wireless base stations and the like.

BACKGROUND OF THE INVENTION

Wireless communications is, in part, accomplished with the use of wireless base station transmit-receive systems. The purpose of a base station is to transmit and receive RF signals, such that they are properly routed to customers using, for example, a cellular telephone network. Base stations are coupled to antennas and amplifiers which are sometimes located more than 100 feet away from the base station itself. The antennas and amplifiers are coupled to base stations with coaxial cables.

In general, antennas are subject to lightning strikes. In the currently discussed setup, when an antenna or a nearby object is struck by lightning, a surge of electricity oftentimes travels through the coaxial cable to the base station. This surge of electricity can cause serious damage to the electronic components in the base station cabinet. Thus, the coaxial cable is typically first connected to a lightning protection device which is only then connected to the base station.

For the purposes of protecting a base station from damage caused by lightning, a protector, employing a quarter wave length bypass, referred to as a quarter wave length protector is employed. Another type of protector, known as a gas-discharge tube, is also utilized.

Typically, the protector is disposed between the coaxial cable line and the base station, which has components which can be damaged by a voltage surge.

A quarter wave length protector includes a portion of a transmission line having a length approximately equal to quarter wave length ($\lambda/4$) of the frequency of the desired signal traveling through the protector. The quarter wave length transmission line is connected between the signal conductor located within the coaxial cable and the external surface of the housing that contains the protector. The quarter wavelength protector acts like a parallel tuned resonance circuit, which exhibits a very high impedance in response to desired RF signals flowing through the signal conductor, and which exhibits a very low impedance in response to signals with low frequencies, such as those caused by lightening. Thus signals caused by lightening experience a short circuit path between the signal conductor inside the cable and the outer housing of the protector.

For gas-discharge type protectors, a gas-discharge tube is positioned between the signal conductor of the coaxial cable and outer housing of the protector. The gas inside the discharge tube is designed to be ionized by lightning surge voltage. The ionization creates a conductive path from the signal conductor inside the coaxial cable and the outer housing. In both cases, rather than the surge of electricity continuing to pass through the coaxial cable and into the base station, the short circuit allows the electricity to pass through the conductive housing of the protector. The housing of the protector is in electrical contact with the base station cabinet. Thus, the cabinet acts as a grounding surface, because as a relatively large metal plate, it is capable of dissipating the energy resulting from the lightning strike.

Coaxial cables are connected to other cables and components inside the base station cabinet, through the use of male and female connectors. In the art, female connectors are known as mating jacks and male connectors are known as plug connectors. Jacks have no moving parts. The outer conductor surface of a jack is fixed and threaded on its outer surface. Plugs, on the other hand, have a movable coupling nut, which is threaded on its inside surface.

Typically, the end of the lightning protector that couples to the base station, also referred as the equipment-side, terminates in a plug. This is due to the fact that a particular filter is often used in the base station which terminates in a jack. The other end of the lightning protector that couples to the coaxial cable terminates in a jack.

A protector having a plug on the equipment-side (i.e., the portion of the plug connected to electronics in the cabinet) can result in inefficient grounding. The noise current traveling on the outer shell of the plug to the cabinet surface will inductively couple back into the center conductor. Because the plug has a moving part, any discontinuity in the outer shell may establish a resistive path which may prevent current from being efficiently grounded. This discontinuity may cause electric arcs referred to as arc-over. Moreover, if the arc-over is severe, there is a fire hazard and the possibility of damage to the equipment. Ultimately the result is that the equipment is not properly protected. The moving part may also result in the varying electrical conductivity between the outer shell of the adapter and ground in different portions of the cabinet surface. In turn, proper quality assurance cannot be guaranteed. Finally, an additional problem is that noise and interference can also be caused by the discontinuity.

One way to overcome the aforesaid problems is to provide a protector that has mating jacks at both ends. In that event, one of the mating jacks is inserted inside the base cabinet through a hole and the other end engages with a coaxial cable that connects to the antenna. Since the jack of the protector does not have any moving parts, the housing of the protector and the cabinet surface from a good connection via the jack. A problem with this arrangement is that the filter used inside the base cabinet also terminates with a mating jack. Thus, in order to connect the filter's mating jack to protector's mating jack, there is a need for an adaptor cable that terminates with plugs at both ends. The adaptor cable can then be disposed between the two jacks.

In such a base station system, there is also a mechanical problem with the currently employed set-up. Due to the length of the coaxial cable, the cable is often twisted in such a way that a large torque is present where the cable must be connected to the base station. This interferes with the goal of obtaining a secure connection between the cable and the base station.

Thus, there is the need for an economical arrangement which prevents inefficient grounding of lightning voltage surges when utilizing lightning protectors with the plug-side of the adapter connected to the equipment.

SUMMARY OF THE INVENTION

In accordance with one embodiment of this invention, a grounding system for an RF coaxial lightning protector comprises a housing which contains an RF coaxial lightning protector. The housing has a jack at one end and a plug at the other end. The system also includes a grounding device fabricated from a conductive material, which is connected to both the housing and a grounding surface. The connections are such that a current signal can pass from the housing to the grounding surface. Because the plug-side of the housing is connected to electronic equipment, a current signal from a lightning strike may pass into the electronic equipment. The grounding device ensures that current will safely pass into the grounding surface rather than the electronic equipment. In a preferred embodiment of the invention, the grounding device is a z-shaped plate.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, may be best understood by reference to the following detailed description when read with the accompanying drawings in which:

DETAILED DESCRIPTION OF THE PRESENTLY PREFERRED EMBODIMENT

Figure 1:
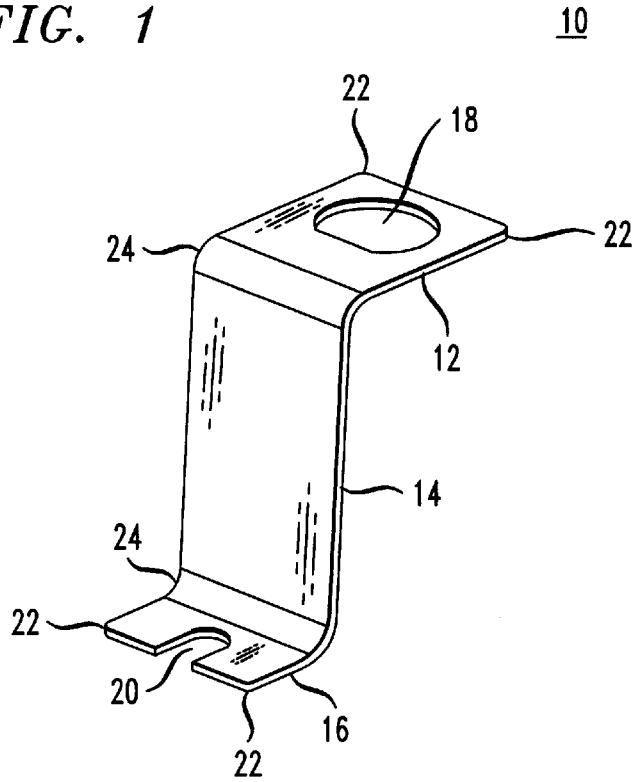
FIG. 1 illustrates a perspective view of a grounding device in accordance with one embodiment of the invention.
Figure 2:
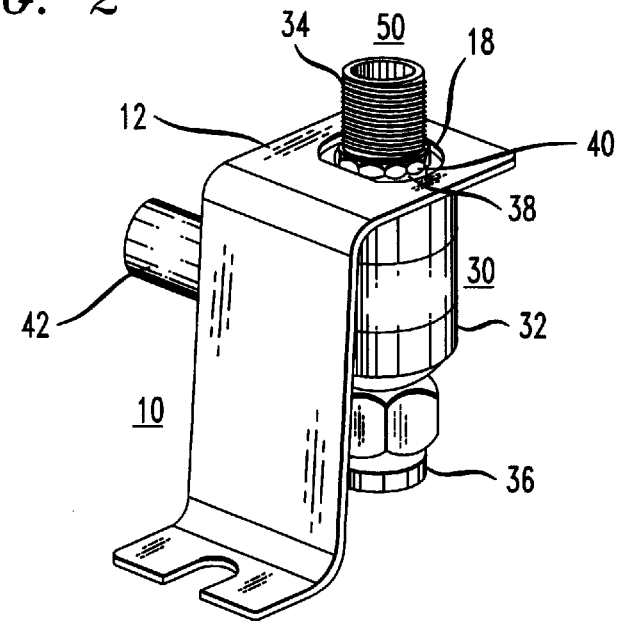
FIG. 2 illustrates the grounding device shown in FIG. 1 as it is designed to be combined with an RF coaxial cable lightning protector to form a grounding system.

FIGS. 1 and 2 illustrate a Z-shaped grounding device 10, preferably made of an electrically conductive material, for use in a grounding system 50 for improvement of performance of an RF coaxial lightning protector 30 in accordance with one embodiment of the invention. The invention, however, is not limited in scope in this respect. For example, other shapes for the grounding device can be used and other types of grounding devices may be used, such as a braided metal strap. The protection device could be incorporated inside any coaxial adapter and is not limited to the type shown in protector 30.

Referring to FIG. 1, grounding device 10 is shown. There are three major portions of grounding device 10 that are formed from a rectangular shaped plate. The portions are protector side 12, body 14, and ground side 16. Protector side 12 has a hole 18. Ground side 16 has a u-shaped hole 20. An important feature of grounding device 10 are corners 22. Corners 22 lack sharp edges. In this embodiment, the protector side and the ground side have been tapered to a more obtuse angle. In another embodiment, corners 22 may be rounded. Corners 22 are treated in such a manner in order to avoid the generation of areas of high inductance and also to allow for the smooth flow of current through grounding device 10. Likewise, bends 24 are rounded for the same reason. Grounding device 10 is also shown to have a width which is approximately one-quarter or less of its entire length. These dimensions substantially reduce the induction voltage generated in grounding device 10. As mentioned above, the induction voltage is typically generated because of lightning surge current that travels through the body of the protector.

Referring to FIG. 2, grounding system 50 is shown. Grounding system 50 is comprised of grounding device 10 in combination with lightning protector 30. Protector 30 is shown to have a housing 32 which has a jack 34 at one end, and a plug 36 at the other end. Jack 34 is shown to be threaded on its outer surface. Plug 36 is threaded on the inside surface (not shown) and its outer conductor is a movable coupling 37. Protector side 12 of grounding device 10 is connected to jack 34 of protector 30 through hole 18. Washer 38 and nut 40 are used to secure grounding device 10 to protector 30 through hole 18 to allow a tight connection of protector side 12 of the grounding device to the jack of housing 32. The quarter wave protector 42 is also shown in FIG. 2.

Figure 3:
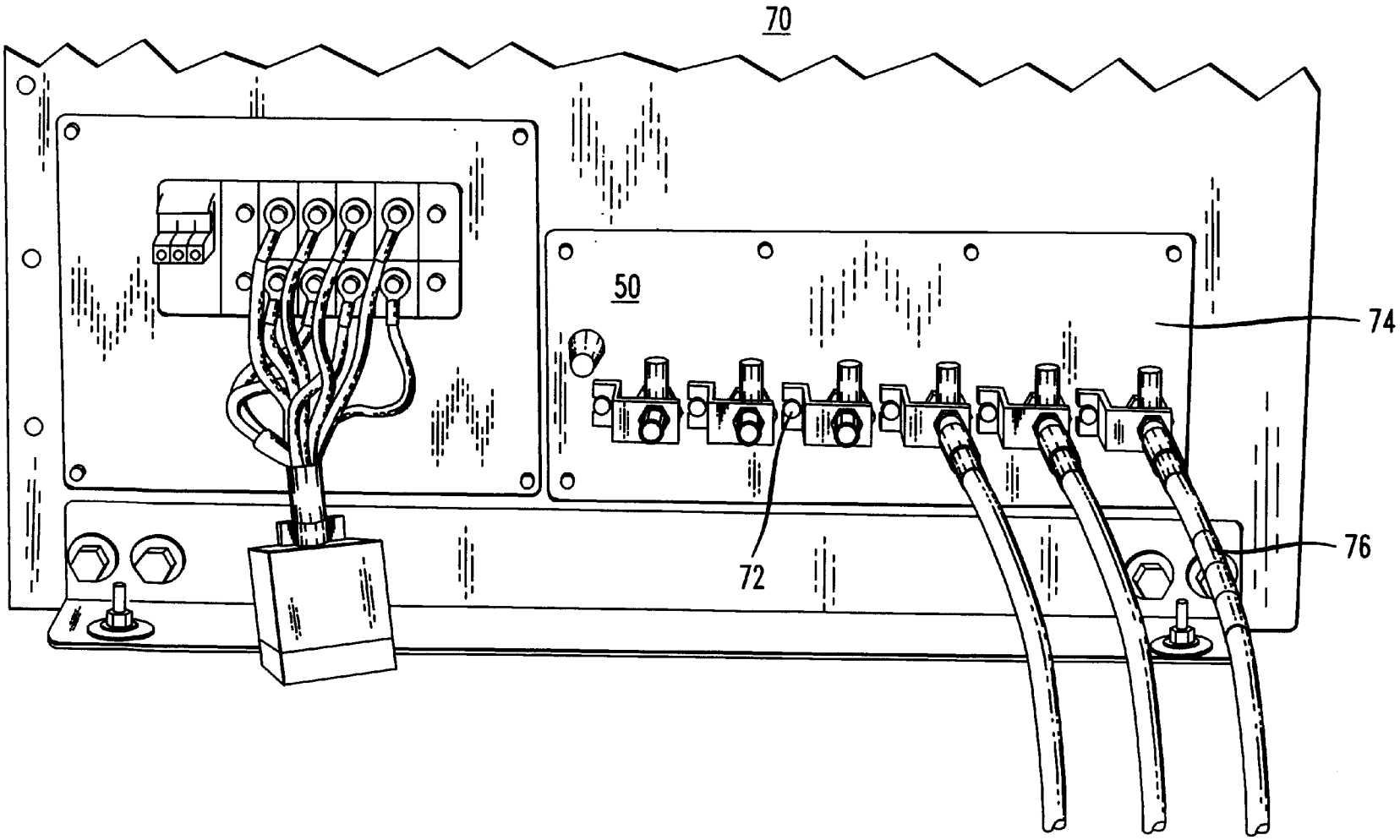
FIG. 3 illustrates the grounding system shown in FIG. 2 as utilized in a base station.

Referring to FIG. 3, the outside surface of a wireless base station cabinet 70 is shown. Six grounding systems 50 are shown installed in base station 70. Each grounding system 50 is installed in base station 70 by connecting plug 36 to a jack (not shown) disposed on the outside of the base station cabinet 70. Furthermore, each fastener 72 is used to connect grounding device 10 to grounding surface 74 via u-shaped hole 20 to allow a tight connection of the ground side 16 of housing 32 to the grounding surface. Coaxial cable 76 is shown connected to jack 34 of protector 30. Surge voltage traveling from an antenna, through the coaxial cable, towards the base station, will be short circuited by quarter wave protector 42. This short circuit allows current to travel into housing 32 of protector 30. Grounding system 50 creates a conductive path via grounding device 10 for current to pass through to grounding surface 74. Without grounding system 50, as shown, current would pass through plug 36 before passing into grounding surface 74. This would be problematic for the reasons discussed above.

Still referring to FIG. 3, as previously mentioned, coaxial cable 76 may at times apply a torque to grounding system 50. This torque may interfere with the goal of a secure connection between grounding system 50 and base station 70. An added benefit of the use of grounding device 10 is its ability to resist a torque applied to its length. Thus, the dimensions, material and thickness of grounding device 10 can be selected so that it provides sufficient support against any torque as specified by a designer. This torque may depend on the length of the of the coaxial antenna cable, its thickness, and its condition of use.

Thus, the present invention solves problems associated with the presently described base station set-up. First, lightning current is shunted to ground surface 74 before it reaches the moving cylinder part of plug 36. This helps to better protect the equipment and serves to reduce electric arcs. Second, grounding device 10 provides additional mechanical strength to protector 30. Grounding device 10 clamps the lightning protector 30 to the base station 70, reducing degradation of protector 30 due to twisting of the long and heavy coaxial cable 76.

While only certain features of the invention have been illustrated and described herein, many modifications, substitutions, changes or equivalents will now occur to those skilled in the art. It is therefore to be understood that the appended claims are intended to cover all such modifications and changes that fall within the true spirit of the invention.

What is claimed is:

1. A grounding system for an RF coaxial lightning protector for directing current to a grounding surface comprising:

a housing for containing an RF coaxial lightning protector, said housing having a jack at a first end, and a plug at a second end adjacent to said grounding surface; and a grounding device fabricated from a conductive material, said grounding device having a body, a ground side connected to said grounding surface and a protector side having a surface defining an opening for receiving and connecting to said jack, said protector side having a bottom surface configured to rest on said first end of said housing to form a current signal path from said housing to said second end of said housing.

2. The system in accordance with claim 1, wherein said grounding device is a z-shaped plate, said z-shaped plate is formed from a rectangular shaped plate, said protector side of said z-shaped plate extending from said body so that said protector side is attachable to said jack of said housing and said ground side of said z-shaped plate extending from said body so that said ground side is attachable to said grounding surface.

3. The z-shaped plate in accordance with claim 2, wherein a width of said rectangular shaped plate is approximately one-quarter the dimension of a length of said rectangular shaped plate.

4. The z-shaped plate in accordance with claim 2, wherein said opening defines a hole having a diameter of approximately the same dimension as the diameter of said jack, so as to allow a tight connection of said protector side of said z-shaped plate to said jack of said housing.

5. The z-shaped plate in accordance with claim 2, wherein said ground side has a u-shaped hole, so as to allow a tight connection of said ground side of said housing to said grounding surface.

6. The z-shaped plate in accordance with claim 2, wherein the corners of said z-shaped plate approximate a rounded shape.

7. The z-shaped plate in accordance with claim 2, wherein bends formed by said protector side and said ground side in combination with said body are rounded.

8. The z-shaped plate in accordance with claim 2, wherein said z-shaped plate is sufficiently rigid to resist a specifiable torque applied by said cable to said housing.

* * * * *